United States Patent [19]

Wildmann

[11] Patent Number: 4,581,994

[45] Date of Patent: Apr. 15, 1986

[54] INK METERING DEVICE FOR A PRINTING PRESS

[75] Inventor: Wolfgang Wildmann, Offenbach am Main, Fed. Rep. of Germany

[73] Assignee: M.A.N.-Roland Druckmaschinen Aktiengesellschaft, Fed. Rep. of Germany

[21] Appl. No.: 629,637

[22] Filed: Jul. 11, 1984

[30] Foreign Application Priority Data

Jul. 11, 1983 [DE] Fed. Rep. of Germany ..... 3324952

[51] Int. Cl.[4] ..... B41F 31/04; B41F 31/06

[52] U.S. Cl. ..... 101/363; 101/365

[58] Field of Search ..... 101/365, 363, 350, 351, 101/157, 169; 118/261, 413

[56] References Cited

U.S. PATENT DOCUMENTS

| | | | |
|---|---|---|---|
| 625,318 | 5/1899 | Bradford | 101/350 |
| 1,778,476 | 10/1930 | Wood | 101/365 |
| 2,161,943 | 6/1939 | Baue | 101/365 |
| 3,057,294 | 10/1962 | Jameson | 101/365 |
| 3,110,254 | 11/1963 | Davis | 101/365 |
| 3,727,550 | 4/1973 | Easoz et al. | 101/365 |
| 3,747,524 | 7/1973 | Crum | 101/365 |
| 3,978,788 | 9/1976 | Cappel et al. | 101/363 |
| 4,058,058 | 11/1977 | Hantscho | 101/365 |
| 4,193,345 | 3/1980 | Schoneberger et al. | 101/365 |
| 4,200,932 | 4/1980 | Schramm et al. | 364/519 |
| 4,328,748 | 5/1982 | Schramm | 101/365 |
| 4,329,923 | 5/1982 | Iida | 101/365 |
| 4,372,207 | 2/1983 | Toyoda | 101/365 |
| 4,381,708 | 5/1983 | Hirt et al. | 101/365 |
| 4,385,560 | 4/1981 | Johne et al. | 101/365 |

FOREIGN PATENT DOCUMENTS

| | | |
|---|---|---|
| 2125288 | 9/1972 | Fed. Rep. of Germany . |
| 3211156 | 6/1983 | Fed. Rep. of Germany . |
| 2059350 | 4/1981 | United Kingdom . |

OTHER PUBLICATIONS

Galster et al. U.S. patent application Ser. No. 543,407 (Oct. 1983).

*Primary Examiner*—Charles A. Pearson

*Attorney, Agent, or Firm*—Leydig, Voit & Mayer, Ltd.

[57] ABSTRACT

An automatic control system for a zonal ink metering device displaces ink metering elements toward a fountain roller until contact of the individual elements with the fountain roller is detected to establish absolute reference positions. Then the ink metering elements are displaced away from the fountain roller by respective predetermined amounts to obtain a desired ink profile. Once the desired ink profile is obtained, continuous printing is started. During continuous printing, the ink profile is maintained by periodically and sequentially reciprocating one individual ink metering element after another into contact with the fountain roller to reset their respective reference positions. Preferably, contact of the individual ink metering elements with the fountain roller is detected by a pair of electrical contacts in the adjusting devices for the ink metering elements. Preferably, a predetermined biasing force is applied urging the ink metering elements into contact with the fountain roller, and the adjusting mechanism applies force through the electrical contacts to displace the ink metering elements away from the fountain roller. Preferably, the ink metering elements are ink slides and electrical contact and force transmission occurs between a contact plate mounted via a rigid insulator to a substantially fixed support and the end of a threaded spindle engaging a nut fixed to the ink slide. Thus, when closure of the electrical contacts occur, the contact plate becomes grounded.

9 Claims, 6 Drawing Figures

INK METERING DEVICE FOR A PRINTING PRESS

FIELD OF THE INVENTION

This invention relates generally to printing presses, and more particulary to ink metering devices for printing presses.

BACKGROUND OF THE INVENTION

Ink metering devices are commonly used to regulate the application of ink to an ink fountain roller in a printing press. One specific type of ink metering device has a series of slides which have edge portions adjacent the ink fountain roller. The amount of ink conveyed by the fountain roller past the slides is regulated by the gap between the edge portions of the slides and the fountain roller. The slides are mounted for radial displacement with respect to the fountain roller to control the amount of ink transferred by the ink fountain roller to the printing press. In order to obtain a variable amount of regulation across the length of the fountain roller to compensate for ink density variations across the printed sheets, each slide is individually adjustable relative to the ink fountain roller. The adjustment of each slide is performed by a respective adjusting motor. An ink metering assembly of this kind is described for example in Cappel et al., U.S. Pat. No. 3,978,788, issued Sept. 7, 1976.

A problem often encountered in using ink metering devices of the kind described above is that the ink profile across the length of the fountain roller does not remain constant during a long period of press operation, and requires readjustment of the slides at regular intervals. The ink profile may change because of excessive bearing play, wear on the slides or the ink fountain roller, or temperature changes. The readjustment process is time consuming and therefore results in less efficient use of the press. Further, since the ink profile settings are determined empirically to obtain a desired ink density across the printed sheet and these variable factors are not considered, automatic presetting and readjustment of the inking unit is hardly possible.

SUMMARY OF THE INVENTION

It is therefore a primary object of the present invention to provide an improved ink metering device which can be adjusted more easily to compensate for changes occuring during the operation of a printing press. In this regard, a related object of the present invention is to provide an ink metering device in which excessive bearing play, wear on the slides or ink foutain roller, and temperature changes do not substantially change a given ink profile.

A further object of the present invention is to provide an ink metering device which can use a single empirically determined setting for a given ink profile after a long period of press operation.

Still a further object of the present invention is to reduce the time required to readjust the slides. In this regard, a related object of the present invention is to reduce the cost associated with slide readjustment resulting from excessive bearing play, wear on the slides or the ink fountain roller and temperature changes.

Another object of the present invention is to increase the overall efficiency of the press during press operations.

And yet another object is to provide an ink metering device which is compact and can be fitted on some existing kinds of ink fountains.

BRIEF DESCRIPTION OF THE DRAWINGS

Other objects and advantages of the present invention will become apparent upon reading the following detailed description and upon reference to the accompanying drawings, in which.

Figure 1:
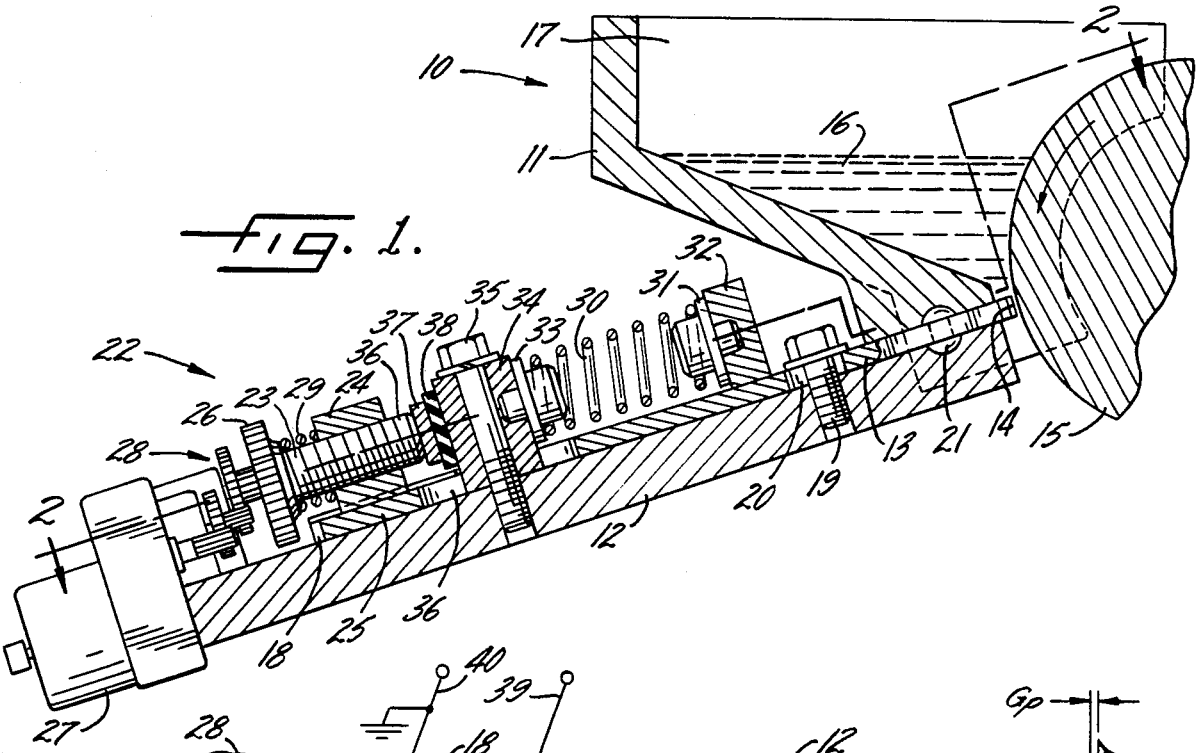
FIG. 1 is a vertical section of the ink metering device in accordance with the present invention taken perpendicular to the axis of the fountain roller.

While the invention is susceptible to various modifications and alternative forms, a specific embodiment thereof has been shown by way of example in the drawings and will be described herein in considerable detail. It should be understood, however, that it is not intended to limit the invention to the particular form disclosed. On the contrary, the intention is to cover all modifications, equivalents, and alternatives falling within the spirit and scope of the invention as defined by the appended claims.

DESCRIPTION OF THE PREFERRED EMBODIMENT

Turning now to FIG. 1 there is shown an ink fountain having a frame generally designated 10 which includes an upper trough portion 11 and a lower or base portion 12. Inserted between the two portions 11, 12 is a metering assembly of slides including a slide 13 having a front edge portion 14 which abuts against the surface of a fountain roller 15. The frame 10 and the fountain roller 15 enclose a trough which carries a body of ink 16. To contain the ink at the ends of the roller 15, the frame 10 has side members such as the side member 17 shown fragmentary in FIG. 1, which abut the end portions of the fountain roller 15. The fountain roller 15 is journaled for rotation to convey a film of ink past the end portion 14 of the slide 13 to other rollers (not shown) in the printing machine.

To precisely regulate the amount of ink conveyed by the fountain roller 15, the slides such as the slide 13 are individually adjustable in the radial direction with respect to the fountain roller. The movement of the slide 13 is limited in the axial direction of the fountain roller by guides 18 fixed to the base portion 12. Displacement of the slide 13 in the radial direction with respect to the fountain roller 15 is also limited to a degree by a retaining screw 19 secured to the base portion 12 and passing through a slot 20 in the slide. To preclude leakage of ink between adjacent slides 13, the adjacent slides are notched along their lateral edges adjacent the front edge portions 14, and the notches are occupied by slightly oversized buttons 21 of resilient sealing material. The relation between the adjacent slides 13 and the guides 18 is further illustrated in the plan view of FIG. 2.

In order to selectively displace the slide 13 in the radial direction with respect to the fountain roller 15, mechanical means generally designated 22 are disposed between the ink slide 13 and the base portion 12. These mechanical means 22 include a threaded spindle 23 engaging a nut 24 affixed to the rear end portion 25 of the slide 13. To precisely rotate the spindle 23, the spindle 23 has a gear wheel 26 rotated by a stepper motor 27 via a gear train generally designated 28. To take up thread lash, a biased compression spring 29 is disposed around the threaded spindle 23 between the gear wheel 26 and the nut 24.

The inventor recognized that even though the slide 13 can be precisely displaced with respect to the base portion 12, this does not guarantee precise displacement of the slide 13 with respect to the surface of the fountain roller 15. Even though the slide 13 is fixed with respect to the base portion 12, the gap between the front edge portion 14 of the slide and the surface of the fountain roller 15 will vary depending upon bearing play at the journals (not shown) of the fountain roller 15, wear on the ink fountain roller 15 or the front end portion 14 of the slide 13, or temperature changes and temperature gradients in the vicinity of the ink fountain 10 or the adjusting device 22.

According to the broadest aspect of the invention, the adjustment of the slide 13 with respect to the base portion 12 is precisely referenced to the position of the fountain roller. In particular the position of the forward end portion 14 of the slide with respect to the base portion 12 is referenced to a "normal position" of the slide 13 wherein the forward end portion 14 contacts the surface of the fountain roller 15. Preferably, this normal or contact position is indirectly sensed by biasing the slide 13 so that the forward end portion 14 contacts the surface of the fountain roller 15 with a predetermined level of force, and using the adjustment means 22 to apply an opposing force tending to lift off the forward end portion of the slide from the surface of the fountain roller. Preferably, the lifting-off of the slide is detected by the closing of a pair of electrical contacts through which the lift-off force is transmitted.

By providing an adjustable biasing force on the ink slide and a way to determine the position of the slide relative to the ink fountain roller, the slide is easily preset and periodically adjusted to compensate for changes occurring during press operation. Also, since the ink slide can be set to a precise absolute position relative to the ink fountain roller, the ink slides across the length of the fountain roller can be set to a predetermined ink profile to obtain desired ink densities across the printed sheet (not shown).

Figure 2:
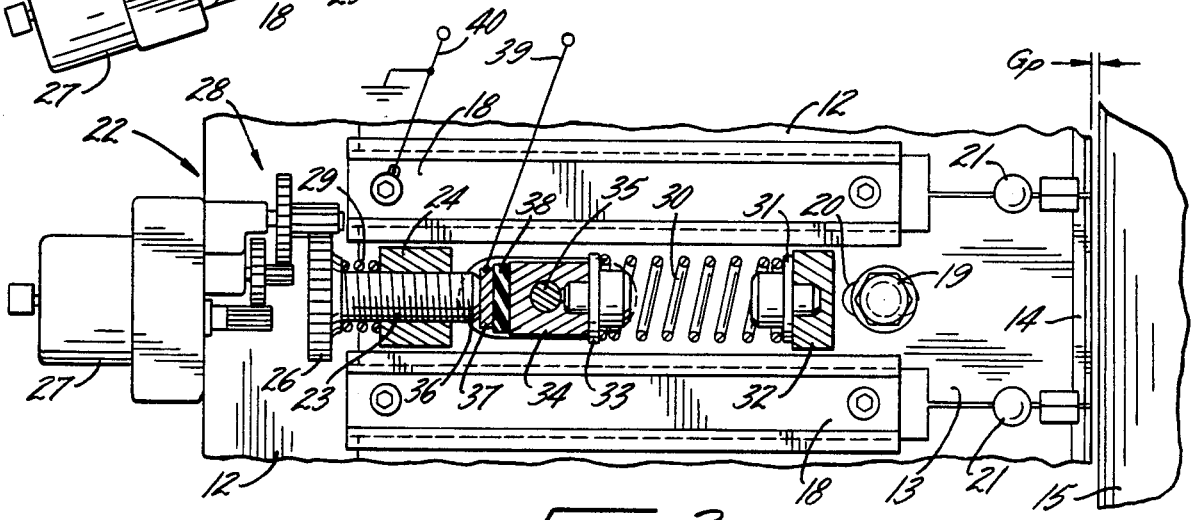
FIG. 2 is a section taken generally along line 2—2 in FIG. 1 when the slides of the ink metering device of the present invention are disengaged from the ink fountain roller.
Figure 3:
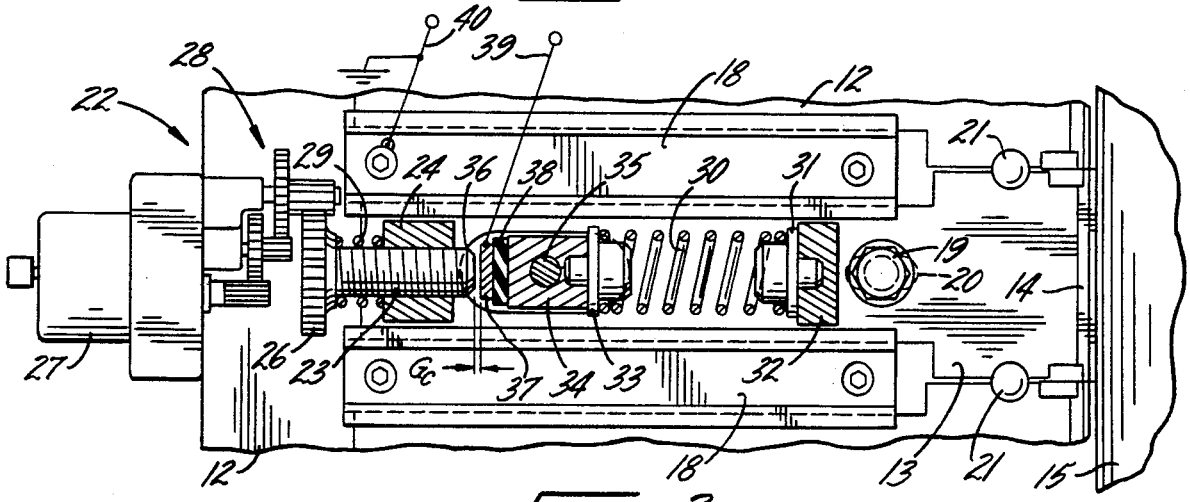
FIG. 3 is a section taken generally along line 2—2 in FIG. 1 when the slides of the ink metering device are engaged with the ink fountain roller.

In the particular embodiment illustrated in FIGS. 1–3, a biased compression spring 30 provides a predetermined level of force urging the slide 13 toward the surface of the fountain roller 15. One end of the compression spring 30 applies force to a plate 31 received in a support 32 fixed to the slide 13. The other end of the spring 30 applies an opposite force to a plate 33 received in a support 34 which is fixed to the base portion 12 via a bolt 35. The bolt 35 and support 34 pass through an aperture 36 in the slide 13 to accomodate the displacement of the slide with respect to the base portion 12.

It should be evident that the position adjusting mechanism 22 permits the ink slide 13 to be urged into contact with the fountain roller 15 by the full force of the spring 30 as in FIG. 3, but can also selectively take up the force of the biased spring 30 to lift off the slide 13 from the fountain roller 15, as shown in FIG. 2. An end portion 36 of the threaded spindle 23 abuts against the support 34 fixed to the base portion 12 in order to oppose and overcome the bias force of the spring 30.

A particular advantage of the position adjusting mechanism 22 is that when the mechanism is adjusted to drive the slide 13 into the fountain roller 15 after the normal or contact position is reached, the spindle 36 will no longer abut against the support 34. The normal or contact position of the slide 13 with respect to the fountain roller 15 is sensed by a pair of electrical contacts through which the adjustment force must pass to oppose the bias force urging the forward end 14 of the slide 13 into contact with the surface of the fountain roller 15. In the preferred embodiment of FIGS. 2 and 3, a contact plate 37 is mounted on the support 34 via a rigid insulating spacer 38. The contact plate 37 and spacer 38 comprise, for example, a piece of copper clad epoxy-fiberglass printed circuit board bonded with adhesive to the support 34. The abutting end portion 36 of the spindle 23 and the contact plate 37 define a pair of electrical contacts through which the adjusting force passes to oppose the bias force of the spring 30. As shown in FIGS. 2 and 3, these electrical contacts are accessed via a connection wire 39 soldered or connected to the contact plate 37 and a ground wire 40 connected, for example, to the base portion 12.

When the abutting end portion 36 of the spindle 23 contacts the plate 37, an electrical circuit is closed from the contact wire 39 to the plate 37, to the spindle 23, to the nut 24, to the slide 13, to the base member 12, and back to the ground wire 40. As is also evident in FIG. 2, when this circuit is closed, rotation of the spindle 23 adjusts the spacing or gap $G_P$ between the forward end portion 14 of the slide 13 and the surface of the fountain roller 15. During adjustment of the gap $G_P$, the spindle 23 does not move axially with respect to the base portion 12. As shown in FIG. 3, when the spindle 23 is rotated by the stepper motor 27 in an attempt to drive the slide 13 into the fountain roller 15, a substantial gap $G_C$ occurs between the abutting end 36 of the spindle and the contact plate 37. This gap $G_C$ opens the circuit between the connecting wires 39 and 40. The position adjusting mechanism 22 permits the spindle 23 to axially move with respect to the base portion 12 as the spindle is rotated to permit the gap $G_C$ to form. It should also be noted that the compression spring 29 takes up axially play between the threaded spindle 23 and the nut 24 in the direction of force transmission. Thus, as the spindle 23 is driven to close the gap $G_C$, to take up the bias force of the spring 30 and to open the gap $G_P$ as shown in FIG. 2, the closing of the circuit between the connection wires 39 and 40 occurs at a very precise position of the forward end portion 14 of the slide 13 with respect to the surface of the fountain roller 15. The desired ink profile is then specified by a predetermined number of steps for each stepper motor 27 needed to drive the respective slides away from the fountain roller 15 to achieve the desired gap $G_P$ across the length of the fountain roller 15.

According to the preferred method for operation of the printing press (not shown) equipped with the ink metering device shown in FIGS. 1–3, the ink metering elements or slides 13 are reset whenever the printing press stops by driving all of the ink slides to their individual normal positions. Thus, changes in the inking gap $G_P$ as a result of wear, temperature, or bearing play are compensated whenever the printing press stops. After the slides are set to their individual normal positions, the slides are stepped back by respective predetermined amounts to reset the ink profile.

According to another aspect of the preferred method, the individual ink metering devices are periodically recalibrated and the profile is maintained during continuous printing. One ink slide after another is driven back to its normal position at periodical intervals during operation of the press and subsequently returned by the respective predetermined number of steps for the respective slide to ensure that the desired ink profile is maintained during operation of the printing press. Thus, small deformations of the ink fountain roller and the ink fountain 10 can be taken into account during continuous printing. Since only one slide deviates from the desired profile at any particular time during the periodic adjustment process, the ink distribution appearing on the printed sheet is not noticeably disturbed. Also, the force of the biasing spring 30 is reasonably proportioned so that damage to the ink fountain roller 15 does not occur even though the forward end portions 14 of the blades 13 intermittently contact the surface of the rotating fountain roller 15 during this periodic recalibration and readjustment method.

Preferably, the initial calibration and subsequent periodic recalibration is automatically performed by a suitable control procedure programmed in a conventional remote control computer or microcontroller for adjusting the ink profile. Microprocessor based remote control systems for printing machines are sold by the major printing machine manufacturers, and a representative system for individually adjusting the ink-dosing elements is described in Schramm et al., U.S. Pat. No. 4,200,932 issued Apr. 29, 1980.

Figure 4:
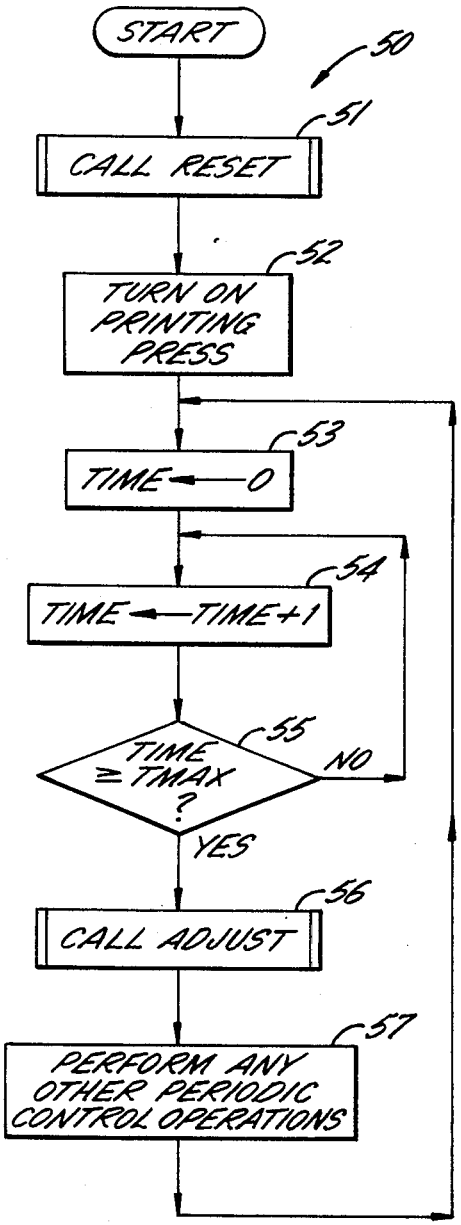
FIG. 4 is a flowchart of an executive procedure used to control the position of the slides of the ink metering device.
Figure 5:
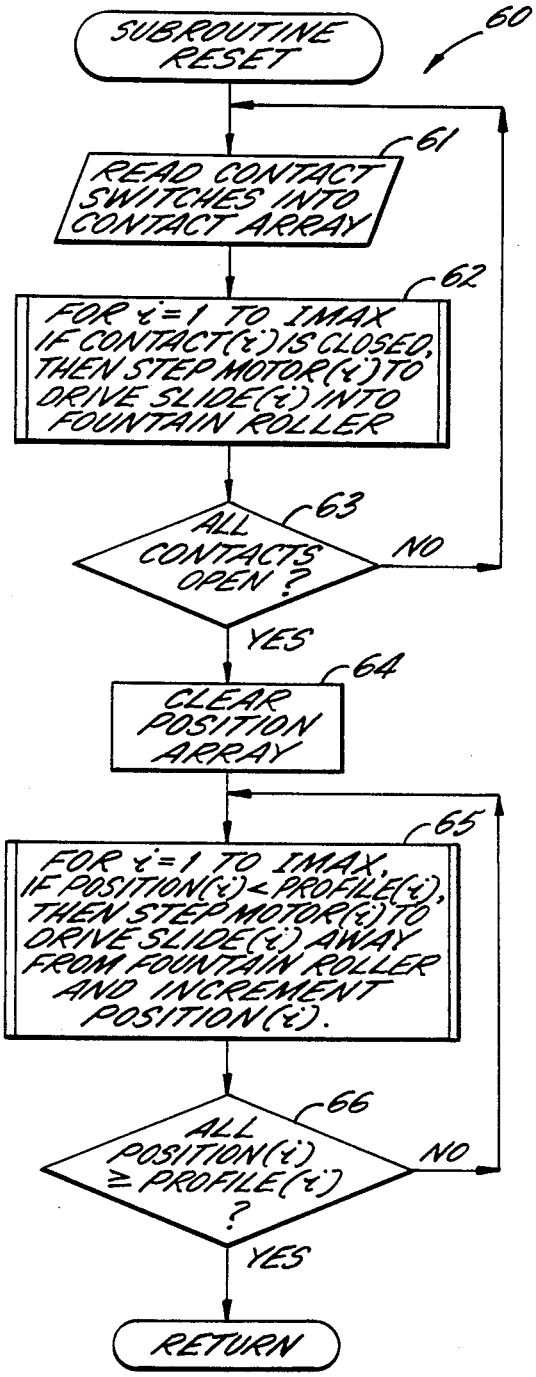
FIG. 5 is a flowchart of a subroutine RESET called by the executive procedure shown in FIG. 4 to preset the ink slides.

Turning now to FIG. 4 there is shown a flowchart generally designated 50 for an executive procedure to initially calibrate the ink adjusting devices and set them to a desired ink profile, and to periodically recalibrate the ink adjusting devices and readjust the ink profile. The executive procedure 50 is started in order to turn on the printing machine at the beginning of a printing operation or to resume printing after an interruption in the printing process. In other words, it is assumed that the printing machine is initially stopped. In the first step 51 a subroutine RESET further described in conjunction with FIG. 5, is called to initially calibrate and adjust the ink slides to obtain a desired predetermined ink profile. Then in step 52, the printing press is turned on to start or resume printing operations.

Figure 6:
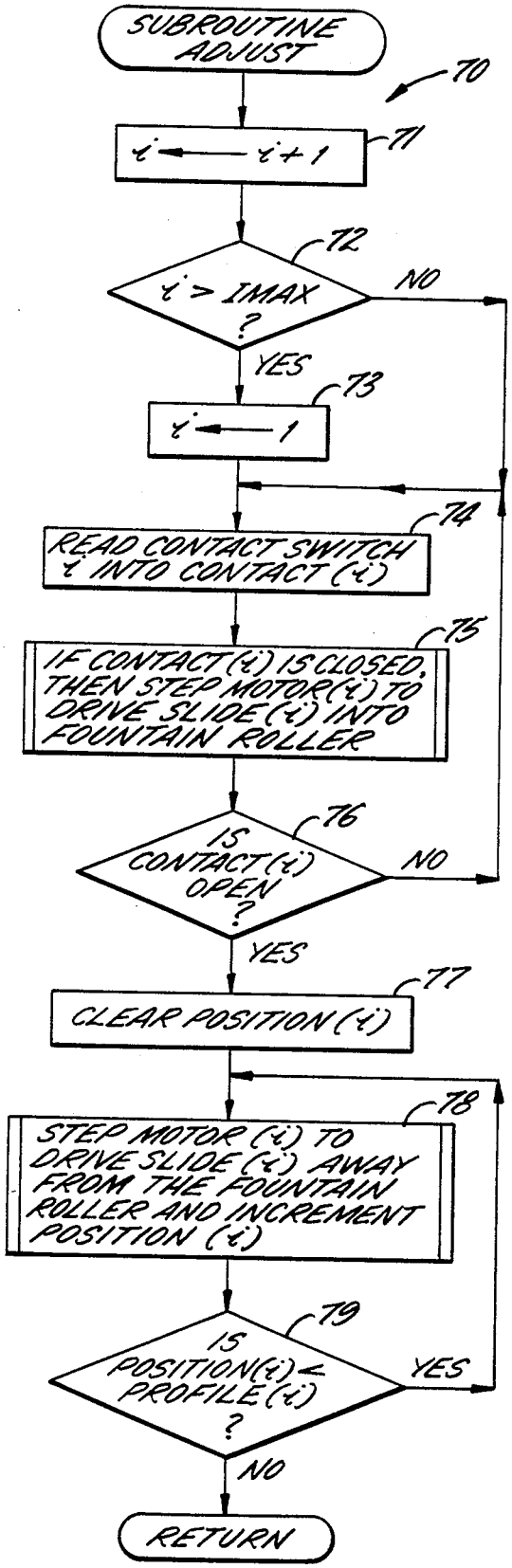
FIG. 6 is a flowchart of a subroutine ADJUST called by the executive procedure in FIG. 4 to periodically readjust the ink slides.

In order to periodically recalibrate and readjust the positions of the slides 13, a timer TIME is used to define the time interval between the adjustments. The timer TIME is cleared in step 53, and iteratively incremented in step 54 until the timer TIME becomes equal to the predetermined desired time TMAX between adjustments, as tested in step 55. At the end of the time interval, the subroutine ADJUST further described in connection with FIG. 6, is called in step 56 to recalibrate and readjust a particular ink slide 13. After this periodic adjustment is performed, the executive control procedure in FIG. 4 may perform other periodic control operations in step 57 which could be unrelated to ink metering for the printing press. After performing any other periodic control operations, execution returns back to step 53 to start another periodic adjustment cycle.

Turning now to FIG. 5 there is shown a flowchart of the RESET subroutine generally designated 60. In general terms, the RESET subroutine drives all of the ink slides 13 into contact with the fountain roller 15, and then retracts the ink slides 13 away from the fountain roller 15 by pulsing the stepper motors 27 by respective predetermined numbers of steps corresponding to the desired ink profile.

To ensure that the ink slides 13 are initially in contact with the fountain roller 15, the RESET subroutine first reads the states of the contact circuits 39, 40 into a CONTACT array in step 61. In other words, the CONTACT array has respective elements corresponding to the ink slides and the value of each element is a logical one or zero indicating whether the respective circuits between the connection wires 39, 40 are open or closed. In step 62 the RESET subroutine checks each element in the CONTACT array, and if an element in the CONTACT array is a logical zero indicating that the corresponding circuit is closed, then a forward pulse is transmitted to the respective stepper motor 27 to drive the respective slide into the fountain roller. Steps 61 and 62 are repeated until all of the circuits are open as tested in step 63, to ensure that all of the slides 13 are in contact with the fountain roller 15.

Once all of the ink slides are in contact with the fountain roller, the normal positions are registered in step 64 by clearing a POSITION array having an element corresponding to each slide 13. Then in step 65, reverse pulses are applied to the respective stepper motors and the pulses are registered by incrementing the respective POSITION array elements so long as the values of the respective POSITION array elements are less than the respective desired values stored in a PROFILE array. When all of the POSITION array elements have values greater or equal to the respective PROFILE array elements as tested in step 66, all of the ink slides 13 have been adjusted to the desired profile and execution returns to the executive procedure 50 in FIG. 4.

Turning to FIG. 6 there is shown a flowchart of the ADJUST subroutine generally designated 70. The ADJUST subroutine 70 is similar to the RESET subroutine 60 in FIG. 5 except that only a particular one of the ink slides is recalibrated and adjusted. The array index i is used to designate the particular ink metering device 22 being recalibrated and readjusted. In step 71, the array index i is incremented to designate the next ink metering device. In step 72 the array index i is compared to a predetermined maximum value IMAX denoting the number of ink metering elements across the length of the fountain roller 15, so that when the index i exceeds the maximum IMAX, the index i is set equal to one in step 73. Then, in step 74 the respective contact circuit including the connecting wires 39, 40 is sensed and its logic state is read into the respective element of the CONTACT array. If the respective circuit is closed, as sensed in step 75, then a forward pulse is fed to the respective stepper motor to drive the respective slide into the fountain roller. Steps 74 and 75 are repeated until the respective contact is open as sensed in step 76. The normal position for the particular slide is registered in step 77 by clearing the respective POSITION array element. In step 78 a reverse pulse is transmitted to the respective stepper motor 27 to drive the respective slide away from the fountain roller, and the reverse step is recorded by incrementing the respective element of the POSITION array. Step 78 is repeated until the value of the respective POSITION array element is greater or equal to the value of the respective PROFILE array element, as sensed in step 79. Execution then returns to the executive procedure 50 in FIG. 4.

In view of the above, an ink metering device has been described which automatically compensates for excessive bearing play, wear on the slides or ink fountain roller, and temperature changes. Due to compensation for these changes, an empirically determined ink profile will suffice even after a long period of press operation. The initial calibration and adjustment is easily and quickly performed by a microcomputer, and periodic recalibration and readjustment may be performed during continuous printing thereby reducing cost and increasing the overall efficiency of the printing operation. The ink metering device is compact and can be fitted on some existing kinds of ink fountains.

What is claimed is:

1. An ink metering device for an inking unit of a printing press comprising, in combination, an ink reservoir, a fountion roller receiving and transferring ink from the reservoir, at least one ink metering element providing an edge portion abutting the surface of the fountain roller, the distance from the edge portion to the surface of the fountain roller determining the amount of ink transferred by said fountain roller, means for displacing the ink metering element by a selected amount with respect to said fountain roller to adjust the distance from the edge portion of the ink metering element to the surface of the fountain roller, and electrical means for sensing when contact occurs between the edge portion of said ink metering element and the surface of said fountain roller thereby sensing a predetermined reference position of said ink metering device, so that said ink metering element can be displaced by said means for displacing by a selected amount after said electrical means indicates said reference position to thereby achieve a predetermined amount of ink transfer by said fountain roller, wherein said means for displacing includes means for limiting the contact force between the edge portion of said ink metering element and said fountain roller to a predetermined value when said means for displacing reduces the distance from the edge portion of the ink metering device to the surface of the fountain roller to zero, wherein said means for limiting said contact force includes means for biasing the end portion of said ink metering element into contact with the surface of said fountain roller, and said means for displacing includes an abutment for transferring an opposing force to displace the end portion of said ink metering element from the surface of said fountain roller, said abutment including a pair of abutting elements which are in contact with each other for transferring said opposing force and which become separated from each other when said end portion of said ink metering element is in contact with the surface of said fountain roller, and wherein said electrical means for sensing includes an electrical circuit using said abutting elements as electrical contacts.

2. An ink metering device for an inking unit of a printing press having an ink reservoir, a fountain roller receiving and transferring ink, a series of ink metering elements arranged across the length of the fountain roller and having edge portions abutting the surface of the fountain roller, the respective distances from the edge portions to the surface of the fountain roller determining respective amounts of ink transferred by the fountain roller, the ink metering elements being displaceable with respect to the fountain rollers independent of each other by respective remotely controllable motors to adjust the respective distances from the edge portions to the surface of the fountain roller, wherein the improvement comprises, respective means for urging the metering elements into contact with said fountain roller, respective means driven by said motors for opposing said means for urging and selectively lifting the metering elements off of said fountain roller including an abutting pair of stops, said stops being in contact with each other and transmitting forces to oppose said means for urging when the metering elements are lifted off of said fountain roller, and said stops being separated from each other when said metering elements are urged into contact with said fountain roller, and respective electrical circuits including said stops for controlling the motors.

3. The ink metering device as claimed in claim 2, wherein said respective means driven by said motors comprise respective threaded spindles so that a linear displacement of the respective ink metering devices are obtained as a function of motor adjustment.

4. The ink metering device as claimed in claim 2, wherein the ink metering elements are flat slides displaceable radially with respect to the fountain roller, said respective means for urging includes respective springs acting upon the slides, said respective means driven by said motors include respective threaded spindles rotated by said motors and engaging respective nuts affixed to the respective slides, and said threaded spindles have end portions comprising respective ones of said abutting pairs of stops, the other respective stops being substantially fixed with respect to said fountain roller.

5. The ink metering device as claimed in claim 4, wherein the substantially fixed stops include respective contact plates mounted on respective rigid insulators.

6. The ink metering device as claimed in claim 4, wherein said slides rest upon a common base portion, said substantially fixed stops are fixed to said common base portion and protrude through respective apertures in the respective slides, said spindles being disposed on the sides of the fixed stops away from the fountain roller, and said respective compression springs being disposed between the fixed stops and respective supports affixed to the respective slides between the fixed stops and the fountain roller.

7. The ink metering device as claimed in claim 4, wherein said spindles include respective gear wheels meshing with respective gears driven by said motors.

8. The ink metering device as claimed in claim 4, further comprising respective springs biasing the respective spindles against the respective nuts in the direction of the axes of the respective spindles to thereby eliminate thread lash.

9. A method for adjusting an array of ink metering elements disposed along a fountain roller in an ink metering device of a printing press, said ink metering elements being individually and selectively displaceable to contact said fountain roller and to separate from said fountain roller to define a gap for regulating the transfer of ink by said fountain roller, said method comprising the steps of:

(a) displacing the ink metering elements toward the fountain roller by applying respective force to the ink metering elements, (b) automatically detecting when contact occurs between each ink metering element and the surface of said fountain roller and thereupon removing said force applied to the respective ink metering element, to define respective reference positions for the metering elements, and (c) displacing the ink metering elements away from said fountain roller by respective predetermined amounts from their respective reference positions, to thereby obtain a desired ink profile, wherein said steps (a), (b) and (c) are performed during continuous printing wherein at predetermined times one metering element after another is displaced to the fountain roller to reset its respective reference position and displaced back by its respective amount to thereby maintain the desired ink profile throughout continuous printing, and wherein a predetermined biasing force is applied urging the ink metering elements into contact with said fountain roller, and the step of detecting contact senses the opening of electrical contacts through which force is selectively applied to displace the ink metering elements away from said fountain roller.

* * * * *